US009718055B2

(12) United States Patent
De Vos

(10) Patent No.: US 9,718,055 B2
(45) Date of Patent: Aug. 1, 2017

(54) PIPETTE TIP, PIPETTE PROVIDED WITH SUCH A TIP, A SET COMPRISING SUCH A PIPETTE TIP AND AT LEAST ONE ENCLOSURE CONTAINING A SAMPLE, AND A METHOD OF USING SUCH A PIPETTE

(71) Applicant: INGENY PCR B.V., GP Goes (NL)

(72) Inventor: Gert De Vos, GP Goes (NL)

(73) Assignee: MOLECULAR BIOLOGY SYSTEMS B.V., 'S-Heer Hendrikskinderen (NL)

( * ) Notice: Subject to any disclaimer, the term of this patent is extended or adjusted under 35 U.S.C. 154(b) by 76 days.

(21) Appl. No.: 14/647,843

(22) PCT Filed: Nov. 27, 2013

(86) PCT No.: PCT/NL2013/050855

§ 371 (c)(1),
(2) Date: May 28, 2015

(87) PCT Pub. No.: WO2014/084731

PCT Pub. Date: Jun. 5, 2014

(65) Prior Publication Data

US 2015/0283540 A1 Oct. 8, 2015

(30) Foreign Application Priority Data

Nov. 28, 2012 (NL) ..... 2009896

(51) Int. Cl.
*B01L 3/02* (2006.01)

(52) U.S. Cl.
CPC ..... *B01L 3/0275* (2013.01); *B01L 2200/141* (2013.01); *B01L 2300/044* (2013.01); *B01L 2300/0672* (2013.01); *B01L 2300/0829* (2013.01); *B01L 2300/0832* (2013.01); *B01L 2300/0851* (2013.01); *B01L 2300/12* (2013.01)

(58) Field of Classification Search
CPC ..... B01L 3/02; B01L 3/021; B01L 3/0275
See application file for complete search history.

(56) References Cited

U.S. PATENT DOCUMENTS

| | | | | |
|---|---|---|---|---|
| 5,169,602 | A | 12/1992 | Pang et al. | |
| 6,716,396 | B1 * | 4/2004 | Anderson | B01L 3/0275 215/232 |
| 7,785,466 | B1 | 8/2010 | Smith | |
| 2001/0039058 | A1 | 11/2001 | Iheme et al. | |

(Continued)

FOREIGN PATENT DOCUMENTS

| | | | |
|---|---|---|---|
| WO | 2006138743 | A2 | 12/2006 |
| WO | 2012161566 | A1 | 11/2012 |

OTHER PUBLICATIONS

International Search Report, dated Jan. 28, 2014, from corresponding PCT application.

*Primary Examiner* — Jan Ludlow
(74) *Attorney, Agent, or Firm* — Young & Thompson

(57) ABSTRACT

A pipette tip having a first end arranged to be fitted to a pipette body (3) of a pipette (1) and having a second end with an opening (15) arranged to be inserted in a sample which is at least in part intended to be drawn up by the pipette, wherein the opening (15) has a sharp profile such that it can be used to cut through a cover (119) covering an enclosure containing the sample.

20 Claims, 4 Drawing Sheets

(56) References Cited

U.S. PATENT DOCUMENTS

| | | | | |
|---|---|---|---|---|
| 2002/0134175 | A1 | 9/2002 | Mehra et al. | |
| 2006/0172433 | A1 * | 8/2006 | Motadel | B01L 3/0241 436/180 |

* cited by examiner

PRIOR ART

PIPETTE TIP, PIPETTE PROVIDED WITH SUCH A TIP, A SET COMPRISING SUCH A PIPETTE TIP AND AT LEAST ONE ENCLOSURE CONTAINING A SAMPLE, AND A METHOD OF USING SUCH A PIPETTE

FIELD OF THE INVENTION

The present invention relates to a pipette tip, a pipette provided with such a tip, a set comprising such a pipette tip and at least one enclosure containing a sample, and a method of using such a pipette.

BACKGROUND OF THE INVENTION

Precise liquid handling is usually performed using pipettes. Pipettes are commonly used in molecular biology, analytical chemistry and medical tests. Pipettes come in several designs for various purposes with differing levels of accuracy, from single piece glass pipettes to more complex adjustable or electronic pipettes. Many pipette types work by creating a partial vacuum above the liquid-holding chamber and selectively releasing this vacuum to draw up and dispense liquid.

Pipettes that dispense between 1 and 1000 micro liter are termed micropipettes, while macropipettes dispense a greater volume. Two types of micropipettes are generally used: air-displacement pipettes and positive-displacement pipettes. In particular, piston-driven air-displacement pipettes are micropipettes which dispense an adjustable volume of liquid from a disposable tip.

FIG. 1 shows the outside of a known pipette 1 with a pipette body 3, a tip 5, a piston 7. The pipette body 3 contains a plunger (not shown) inside, which provides suction to pull liquid into the tip 5 when the piston 7 is compressed and released. The maximum displacement of the plunger is set by a dial 9 on the pipette body 3, allowing the delivery volume to be changed.

Larger capacity tubular pipettes, such as volumetric or graduated pipettes, are used by temporarily attaching a pipetting dispenser. Pipetting syringes typically handle volumes in the 0.5 mL to 25 mL range. Micropipettes use disposable tips to avoid contamination of samples.

Pipettes working with disposable tips 5 are usually micro pipettes. Tips are mostly made from polypropylene, because of its inertness in chemical reactions, it's resistance to chemical compounds and it's flexibility. This flexibility is necessary to provide an airtight seal between the pipette tip 5 and the pipette body 3. When using a harder material for the pipette tip 5, a softer, flexible insert (not shown) can be used in the tip 5 on the pipette side of the pipette tip 5, to provide the airtight seal between the pipette tip 5 and the pipette body 3. It is also possible to use a pipette with one or more sealing o-rings of suitably soft material to seal any space between the pipette body 3 and the tip 5.

In drawing up liquid from an open vessel, such as an opened Eppendorf tube or micro titer plate, flexibility is no problem. When loading a very narrow gel (for example a sequencing gel) flexibility may become a problem, as tips need to be ultra thin at the drawing/dispensing end to be able to fit between the glass plates holding a very thin gel. Tips made from a flexible material, such as polypropylene will not be rigid enough to keep their shape. In this case polycarbonate may be used (Drummond-Sigma).

In molecular biology, nucleic acid amplification techniques such as PCR (Polymerase Chain Reaction) are used for amplification of short polynucleotide sequences of RNA or DNA (up to 1000 nucleotides, but occasionally longer, up 10.000 nucleotides or even longer). The PCR process has been performed for the first time in 1989 by Kary Mullis. Another example of such a process is NASBA (Nucleic Acid Sequence-Based Amplification).

When performing PCR in a sealed enclosure, made from a suitable plastic foil (PCT/NL2011/050354, unpublished), it may be cumbersome to retrieve the sample from the enclosure. By providing a holding block, having the negative form of the foil with enclosures, the enclosures may be fixed in a block for further processing. Micro titer plates sealed by adhesive films (plate sealers) can be used without negative blocks as a holder. Several means can be used for opening the enclosures. With a knife (for example a scalpel) or another sharp object from a suitable material the enclosures may be opened, making the liquid sample in the enclosures available for aspiration by a pipette. Cross contamination is a danger. Alternatively the samples can be drawn up by a syringe, holding a sharp needle. Usually both syringe and needle must be disposed of after drawing up one sample, to avoid contamination of following samples, making this a costly procedure. Sealed micro titer plates can be opened by removing the adhesive plastic foil (plate sealer).

SUMMARY OF THE INVENTION

At least in the field of PCR, there is a need for a suitable device to draw (portions of) samples from an enclosure made from or covered with a plastic foil in an easy and cost effective way. Other examples are tubes containing blood or infectious agents, covered by a seal, which can be punctured.

The object of the invention is to provide such a device.

To that effect, the invention provides a pipette as claimed in claim 1. Embodiments of this device are claimed in other claims.

Moreover, claims are directed to a pipette provided with such a tip, a set comprising such a pipette tip and at least one enclosure containing a sample, and a method of using such a pipette.

BRIEF DESCRIPTION OF THE DRAWINGS

The invention will be explained in detail with reference to some drawings that are only intended to show embodiments of the invention and not to limit the scope. The scope of the invention is defined in the annexed claims and by its technical equivalents.

The drawings show:

FIG. 2*a* shows a cross section of an embodiment of a tip of a pipette, whereas

DETAILED DESCRIPTION OF EMBODIMENTS

Figure 1:
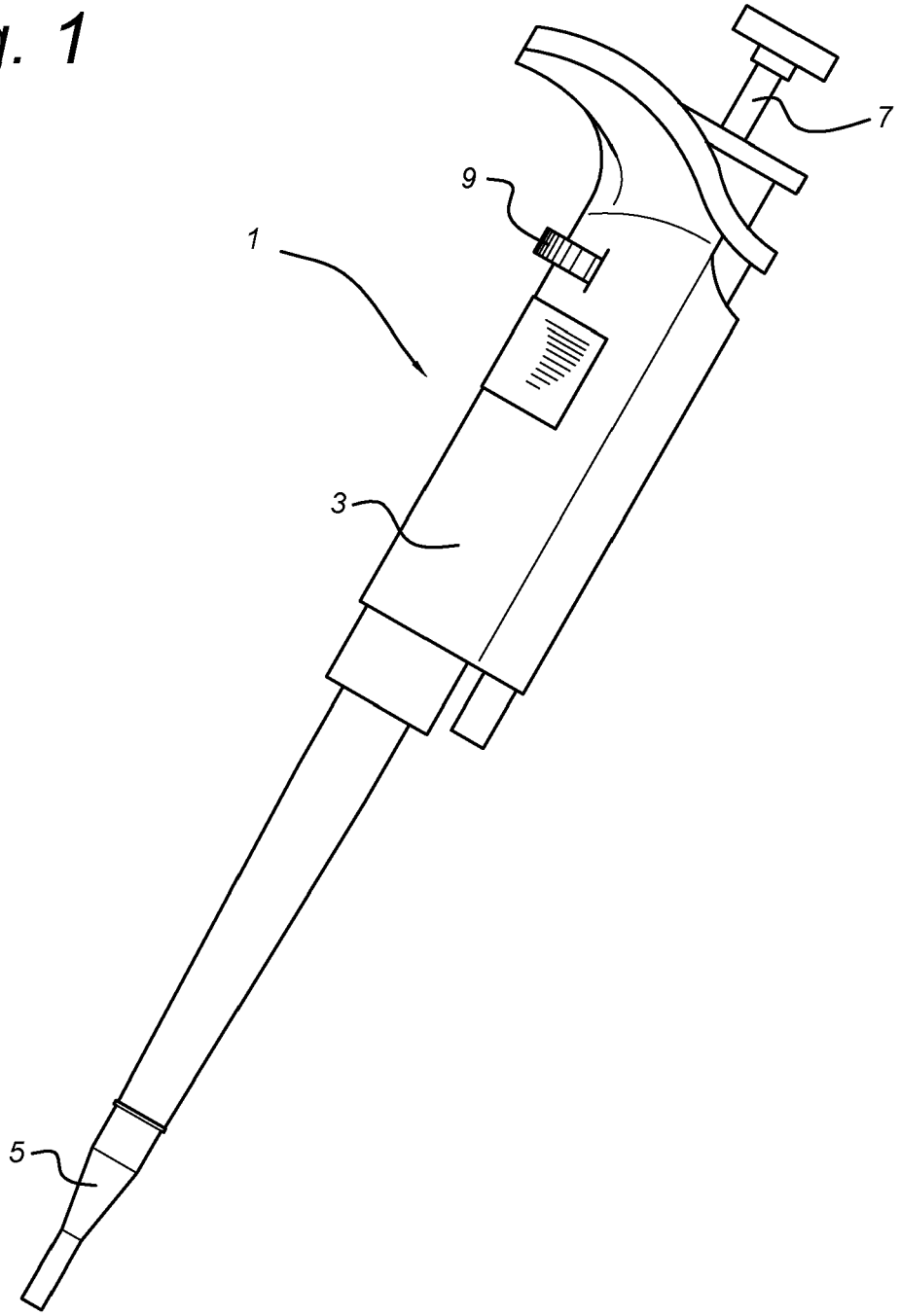
FIG. 1 shows a pipette as known from the prior art.
Figure 2A:
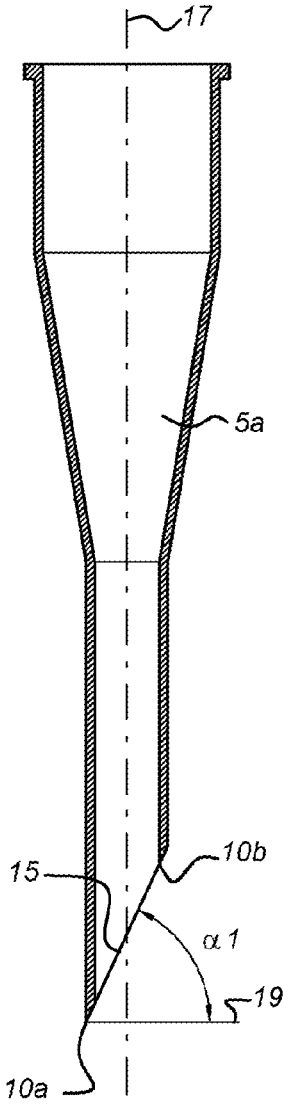

FIG. 2*a* shows a cross section of a pipette tip 5*a*. The pipette tip 5*a* has an opening 15 to be used to be inserted into a sample and draw (a portion of) the sample into the pipette 1. In accordance with the invention, the opening 15 is inclined with respect to a plane 19, which is located perpendicular to a central axis 17 of the pipette tip 5*a*. in FIG. 2*a*, the inclination is indicated with an angle α1.

The opening 15 is defined by an edge 10 (FIG. 3*a*) which has a part 10*a* extending most far from the pipette tip 5*a*, and a part 10*b* extending least far from the pipette tip 5*a*. In the embodiment of FIG. 2*a*, the whole edge 10 is inclined relative to plane 19 at the same angle α1 as opening 15.

By doing so, the end portion of the pipette tip 5*a* as defined by edge 10 is so sharp that it can cut through (thin) plastic foils covering enclosures containing samples to be drawn by the pipette 1.

Figure 2B:
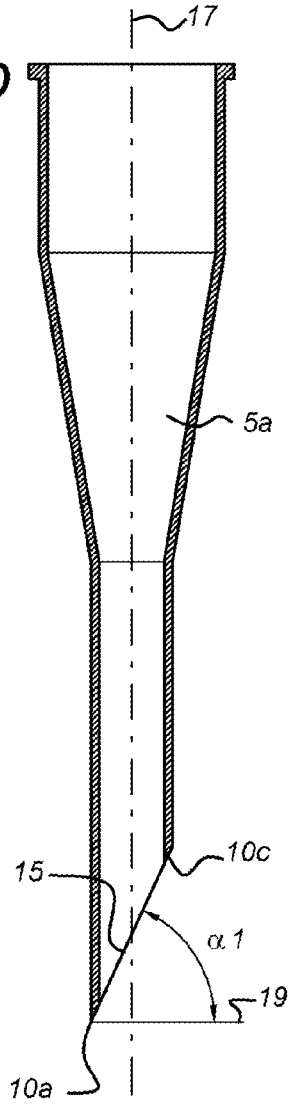
FIG. 2*b* shows a cross section of an alternative embodiment.

In an embodiment, shown in FIG. 2*b*, a part 10*c* of the edge 10 does not show a sharp transition to either the inside or the outside of the pipette tip 5*a*. To that effect, part 10*c* may, e.g., be flat and located in a plane parallel to plane 19. Alternatively, or additionally, part 10*c* may be rounded at its transition to at least one of the inside and outside of the pipette tip 5*a*. The effect of this feature is that, when one cuts through a sheet, like a plastic foil, with the pipette tip 5*a*, cutting will be prevented at a location corresponding to part 10*c*. This will prevent the pipette tip 5*a* from cutting complete holes in the sheet, i.e., a cut away part of the sheet will remain attached to the remainder of the sheet and will be prevented from being stuck within the pipette tip 5*a* or from falling into the sample.

Figure 3A:
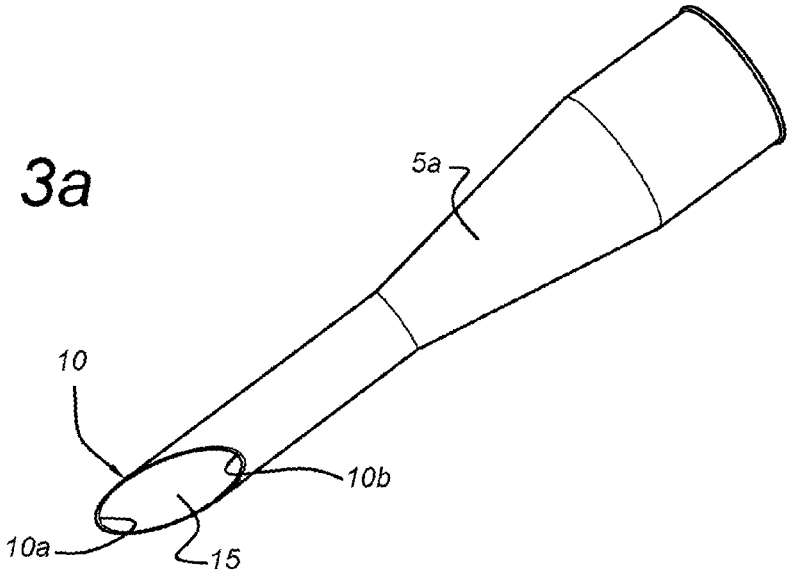
FIGS. 3*a* and 3*b*, respectively, shows a side view of the pipette according to FIGS. 2*a* and 2*b*, respectively.

An advantageous location for part 10*c* is a portion of edge 10 least far extending from pipette tip 5*a*, i.e. corresponding with part 10*b* in FIG. 2*a*, 3*a*. However, any other location may chosen instead, although a portion extending farthest from the pipette tip 5*a* may not always be advantageous. It is best when that latter portion is sharp because that portion touches the sheet to be cut first.

The edge 10 has a total length and the part 10*c* of the edge 10 preferably extends along a maximum of 10%, more preferably a maximum of 5%, and most preferably a maximum of 3% of the total length.

Figure 3B:
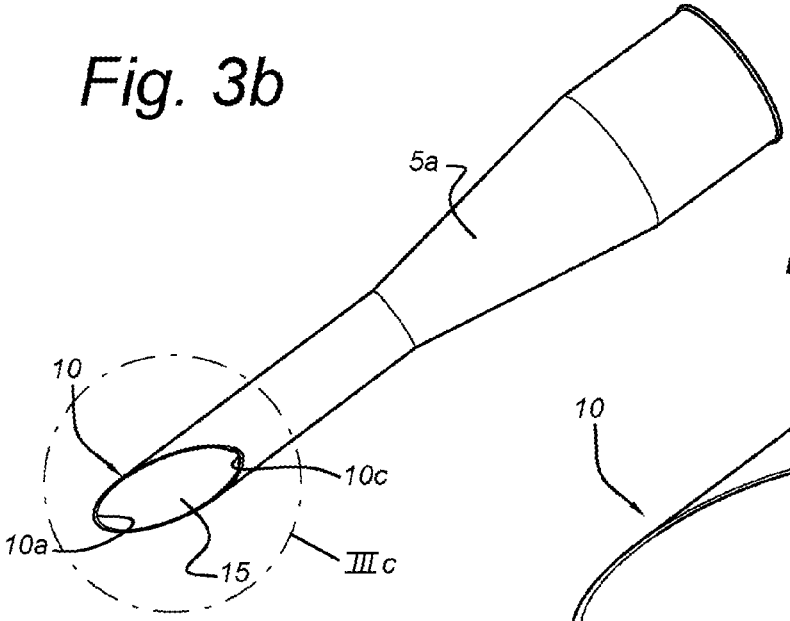
Figure 3C:
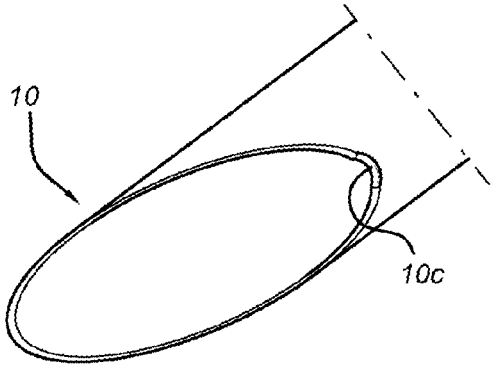
FIG. 3*c* shows an enlarged view of an edge of an end part of the pipette tip.

FIG. 3*b* shows a 3D vision of the pipette tip 5*a* of FIG. 2*b*. FIG. 3*c* shows an enlarged view of edge 10 of the pipette tip 5*a* of FIGS. 2*b*, 3*b*, corresponding to the circle IIIc in FIG. 3*b*.

In general, the angle α1 is ≥0, preferably between 5 and 90 degrees, more preferably between 30 and 50 degrees, and most preferred between 30 and 45 degrees. If α1=0, then the edge 10 itself should be inclined itself such as to provide a sharp end of the pipette tip 5*a* (cf. FIGS. 4*a*-4*c*). A pipette tip 5*a* with α1=0 may advantageously be used in cases where the pipette tip 5*a* is used to suck up a liquid entirely up till a (flat) bottom of an enclosure.

This is especially true when the pipette tip 5*a*, to be fitted to a (micro) pipette body 3, is made from a sufficiently rigid and strong material: for example, but not limited to stainless steel or a thermoplast, for example, but not limited to polycarbonate, polyphenyleneoxide, thermoplastic polyurethane, polysulfone, polyetherimide, polyethersulfone or polyphenylsulfone. Other polymers may be used as well. Such materials may be reinforced with at least one of carbon fibers and glass fibers. An other alternative is polypropylene, possibly reinforced with at least one of carbon fibers and glass fibers. When pushed against the plastic foil the hard, sharp pipette tip 5*a* will cut through the plastic foil of the enclosure, after which the pipette 1 can be used to draw up the sample and dispense it as necessary, after which the pipette tip 5*a* can be disposed of, as one would do with any other pipette tip.

Figure 4A:
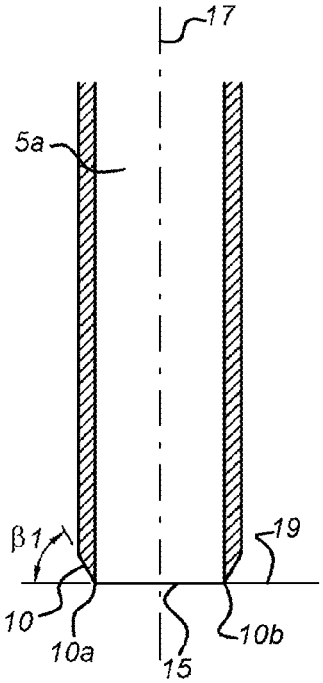
FIGS. 4*a*-4*c* show cross sections of alternative tips of a pipette.
Figure 4B:
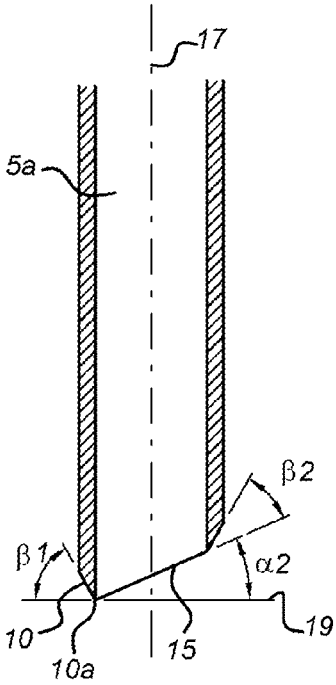
Figure 4C:
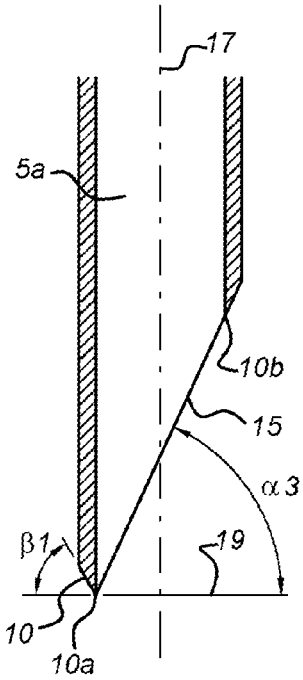

FIGS. 4*a*-4*c* show other examples of openings 15 of pipette tips 5*a*. In general terms, they show examples of openings 15 defined by an edge 10 which is cut in such a way that the edge 10 itself is inclined at an angle β relative to opening 15.

FIG. 4*a* shows an embodiment where opening 15 is not inclined relative to plane 19 (α=0) and the edge 10 is circumferential symmetric such the angle β=β1 along the whole edge 10.

Note that FIG. 4*a* shows a situation where the pipette tip 5*a* has an inner surface extending farther than an outside surface. However, angle β=β1 may have a value such that the outside surface extends farther than the inside surface.

As will be apparent to a person skilled in the art, when using a pipette tip 5*a* as shown in FIG. 4*a* it may have the effect of perforating a foil. If this is an undesired situation, one may use other openings 15 like the ones shown in FIGS. 4*b* and 4*c* (as well as the one shown in FIG. 2*a*).

FIGS. 4*b* and 4*c* have in common that the edge 10 is inclined relative to opening 15 at an angle β which differs per location on the edge 10. Preferably, the most far extending part 10*a* is provided with the highest inclination such as to cut through a foil easily. So, angle β2 at least extending part 10*b* may be less than angle β1 at the most extending part 10*a*. It is possible that angle β2=0 (FIG. 4*c*) or that angles β1 and β2 have opposite signs. β1 and β2 are preferably in a range between 5 and 90 degrees, more preferably between 30 and 50 degrees, and most preferred between 30 and 45 degrees.

In an embodiment, said edge 10 has a surface which is inclined at said second angle β1; β2; β3 relative to said opening which angle is ≥0, having the property that said edge is inclined at said second angle β1; β2; β3 only for part of said opening.

Like the pipette 5*a* of FIG. 2*b*, also the pipette tips 5*a* of FIGS. 4*a*-4*c* may be sharpened partially, in order to leave part of the circle or oval, comprising the opening 15 of the pipette tip 5*a* at the liquid handling side, blunt. This may be implemented with a non-sharpened part in the same way as with pipette 5*a* of FIG. 2*b*. This will have as effect that when cutting through a foil, not the whole shape of the pipette tip 5*a* will be cut out of the foil, but only part, thus creating a flap, connected to the rest of the foil. Cutting the whole shape may result in a situation, where the cut out foil may enter the pipette tip 5*a* and block the entrance of the tip 5*a* or otherwise hinder precise liquid dispensing.

The pipette tips 5*a* may be used in arrangements with robotic pipetters, as will be apparent to persons skilled in the art.

Automatic robotic pipetters can work with liquid sensing pipette tips. The pipette tips as described here can be made such as to have liquid sensing function, e.g., by making them electrically conducting. This can be done in ways known to one skilled in the art, e.g. by mixing carbon particles as an additive through the thermoplasts used for production of the tips. Steel tips are already electrically conducting. Such conducting tips may then be electrically connected to a controller within the robotic pipette which controller also controls its other functions. Alternatively, the sensing function may also be performed by a separate (dedicated) controller connected to the electrically conducting pipette tip and arranged to communicate with that controller. The robotic pipetter employs the electrical conductivity to sense the presence of liquid contacting the tips.

The present pipettes can advantageously be used in PCR methods. In conventional thermocyclers PCR is performed in micro titer plates (for example holding 8 rows of 12 wells, in total 96 wells), which can be sealed by a self adhesive foil on the top (plate sealer). The sealed plates are inserted in the thermocycler, after which the plate sealer needs to be removed in order to provide access to the samples for micro pipettes or robotic pipettes. By using the pipette tips 5*a* described here removing the plate sealer prior to pipetting may be omitted. The pipette tips 5*a* are able to cut through the plate sealers if the pipette tips 5*a* are made from a suitable material (for example polycarbonate) and made sharp enough at the opening 15.

In an advantageous embodiment the pipette 1 according to the invention can be used to cut through a foil covering an enclosure as shown in non pre-published patent application PCT/NL2011/050354. That application discusses a PCR device and method where samples can be enclosed and drawn up. By using the present pipette tips openings in the foils can be made with the pipettes themselves.

Now the enclosures as discussed in PCT/NL2011/050354 will be described with reference to FIGS. 5*a*-5*c*.

Enclosures are produced filled with a PCR reaction mix. Such a PCR reaction mix may comprise water, DNA-template, DNA polymerase, nucleotides, primers, buffer, MgCl2 and PCR enhancers and other substances, which may help the PCR reaction.

Enclosures can be made from very thin material, because the shape of the enclosure is not dependent on the rigidity of the material. Its shape is also not necessarily fixed. The enclosures may have walls down to 0.01 mm or thinner, depending on the strength and other properties of the material of which the enclosure is made. These thin walls help generate extreme temperature ramps. To obtain such high temperature ramps, the volume of one enclosure may advantageously be in the range of 5 to 100 μl, preferably in the range of 10 to 50 μl, most preferably in the range of 10 to 20 μl.

The enclosure consists of a suitably temperature resistant plastic, which does not interfere with the PCR reaction and which can be closed on all sides, even after the mix has been added and thus moisture may be present at the site of sealing.

An example of such an enclosure is a bag, which may be produced in a way as explained with reference to FIGS. 5*a*-5*c*. FIG. 5*a* shows a device 101 for producing such enclosures in the form of bags.

Figure 5A:
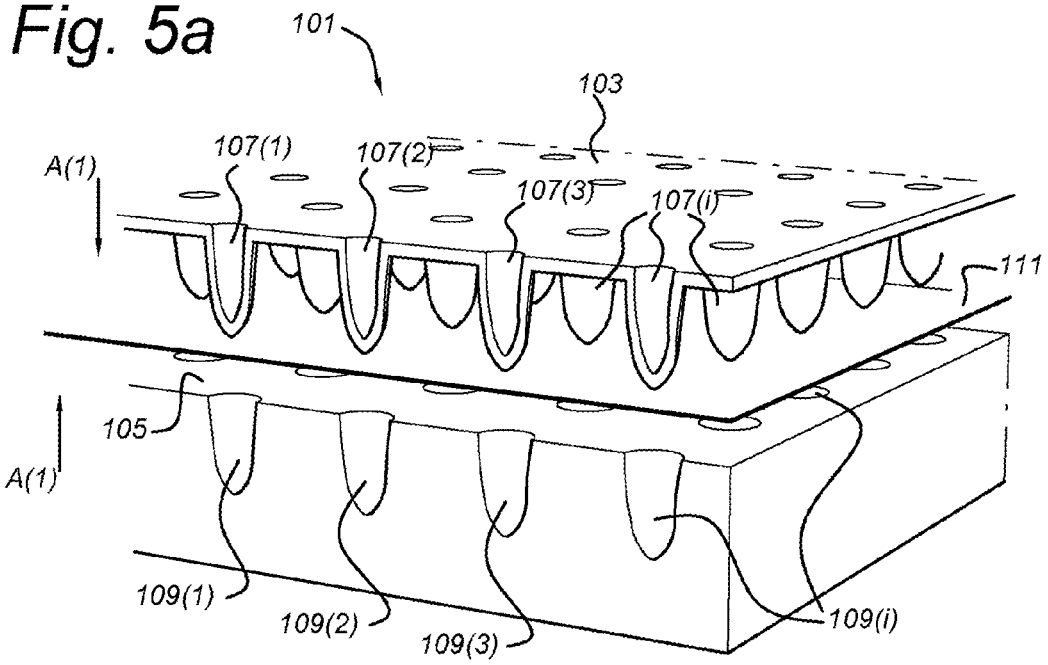
FIGS. 5*a*-5*c* show successive steps of a method to make sealed bags containing a liquid sample, for example DNA material, from which a liquid sample, for example DNA material, can be drawn up with a pipette according to the invention.

FIG. 5*a* shows the device 101 with a first plate 103 and a second plate 105, both shown in cross sectional view. The first plate 103 has one or more extensions 107(*i*). These extensions may be hollow as shown. However, they may also be solid. They may have a circular cross section in a first view parallel to a top surface of the first plate 103. They may have a oval shaped cross section in a second view perpendicular to the first view. However, embodiments are not restricted to these shapes. For example, the cross sectional view parallel to the surface of the first plate 103 may be rectangular or may have any other suitable cross section shape.

The second plate 105 has one or more openings 109(*i*) arranged such and shaped such that each opening 109(*i*) can receive a corresponding extension 107(*i*) of the first plate. Preferably the outer shape of the extensions 107(*i*) substantially corresponds to the inner shape of the openings 109(*i*).

In order to form one or more bags 117(*i*) a plastic foil 111 is arranged between the first plate 103 and the second plate 105. Both the first plate 103 and the second plate 105 are heated to a predetermined temperature. These temperatures may be equal and are chosen such as to soften the plastic foil 111 when the plates 103 and 105 contact the plastic foil 111. As indicated by arrows A(1), the first 103 and second plate 105 are moved towards one another such that each extension 107(*i*) is received by a corresponding opening 9(*i*). The softened plastic foil is pushed into openings 9(*i*) by extensions 107(*i*) such as to form bags 117 (*i*) (FIG. 5*b*). As many bags 117(*i*) will be formed as there are extensions 107(*i*) and openings 9(*i*). These bags 117(*i*) are connected to one another by the portion of plastic foil 111 not pushed inside openings 9(*i*).

It is observed that one of the plates 103, 105 may remain in a fixed position and only the other one need be moved in order to generate the movement as indicated by arrows A(1). The plates 103, 105 may be made of aluminium, steel or any other material with sufficiently high melting temperature and sufficiently high heat transfer coefficient. Their temperature in use may be in a range between 323 K and 573 K, more preferably 323 K and 473 K, most preferably 373 K and 443 K, in case the plastic foil is propylene. The plastic may be polypropylene. However, any other suitable material may be used instead, such as e.g. polyethylene, polyethene, PMMA (=polymethylmethacrylaat), POM (=polyoxymethylene), etc.

The plates 103, 105 are removed from one another and the plastic foil 111 with bags 117(*i*) are removed from the device 1. Then, the plastic foil 111 with bags 117(*i*) is arranged such that the bags 117(*i*) are inserted into corresponding openings 115(*i*) in a third plate 113. The third plate 13 is not heated (so, is at room temperature or may be cooled if the sample requires so) and may be made of glass, a suitable metal or a suitable polymer.

Figure 5B:
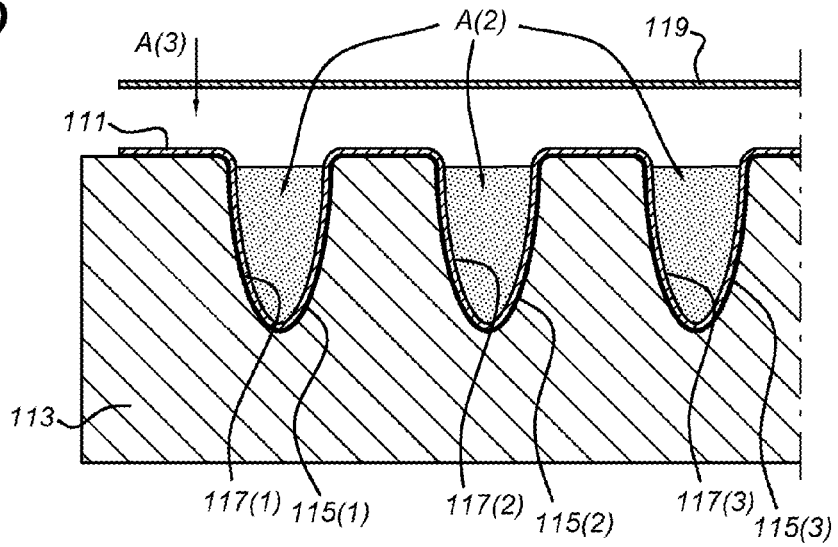
Figure 5C:
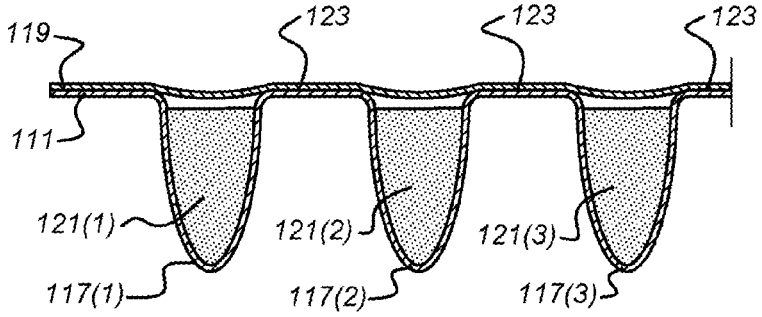

Once inserted in the openings 115(*i*) the bags are filled with a predetermined PCR reaction mix, as indicated in FIG. 5*b*, with arrows A(2).

A further plastic foil 119 is provided on top of plastic foil 111. As indicated with arrows A3 this further plastic foil 119 is laid down on the plastic foil 111. At locations 123, see FIG. 5*c*, the further plastic foil is sealed to plastic foil 111. Locations 123 are located between bags 117(*i*) and are locations where further plastic foil 119 contacts plastic foil 111. For sealing any suitable means and methods may be used, such as gluing, heating, applying ultra sound etc. Ultra sound may be preferred using frequencies in the range of 21000 and 100000 Hz, more preferably between 35000 and 45000 Hz, most preferably between 38000 and 42000 Hz.

Using these frequencies will avoid any moisture present in the enclosures from being heated too.

The extensions 107(*i*) and openings 9(*i*) may be arranged in a matrix arrangement. Then, the bags 117(*i*) will also be arranged in a matrix arrangement. Any number (for example 96) of bags may be placed in parallel in separate lines, or connected. bags may also be joined in series to create a matrix of bags. Alternatively, a sheet of polypropylene foil can be produced to include rows and columns of bags 117(*i*) (e.g. one row in 8 or 12 columns, or 12 rows in 8 columns). Bags 117(*i*) may be circular, rectangular or may have any other suitable cross section shape. Numbers are meant to serve as an example.

A method in which a pipette with a pipette tip 5*a* according to the invention can be used comprises the following actions:

a) Providing a pipette with a pipette tip according to the invention;
b) Providing an enclosure covered with a cover and containing a sample;
c) Cutting through said cover with said pipette;
d) Drawing up said sample, at least in part, by means of said pipette.

As should be evident to persons skilled in the art, application of the pipette tips 5*a* in PCR methods is merely mentioned as an example. The pipette tips 5*a* can be used to retrieve liquid samples from any sealed or closed enclosure, without prior opening of the container.

It is to be understood that the invention is limited by the annexed claims and its technical equivalents only. In this document and in its claims, the verb "to comprise" and its conjugations are used in their non-limiting sense to mean that items following the word are included, without excluding items not specifically mentioned. In addition, reference to an element by the indefinite article "a" or an does not exclude the possibility that more than one of the element is present, unless the context clearly requires that there be one and only one of the elements. The indefinite article "a" or an thus usually means "at least one".

The invention claimed is:

1. A pipette tip comprising:

a first end arranged to be fitted to a pipette body (3) of a pipette (1); and a second end with an opening (15) defined by an edge (10) arranged to be inserted in a sample which is at least in part intended to be drawn up by said pipette, wherein said second end with said opening (15) has a sharp profile such that said second end can cut through a cover (119) covering an enclosure containing said sample, said sharp profile being implemented by:

said second end with said opening (15) being inclined at a first angle ($\alpha$1; $\alpha$2; $\alpha$3) relative to a plane (19) defined perpendicular relative to a central axis (17) of said pipette tip (5*a*), said first angle ($\alpha$1; $\alpha$2; $\alpha$3) being >0, and said edge (10) having a surface which is inclined at a second, extra angle ($\beta$1; $\beta$2; $\beta$3) starting from said opening, and wherein said pipette tip (5*a*) is comprised of thermoplast.

2. Pipette tip according to claim 1, wherein first angle ($\alpha$1; $\alpha$2; $\alpha$3) is between 5 and 90 degrees.

3. Pipette tip according to claim 2, wherein said first angle ($\alpha$1; $\alpha$2; $\alpha$3) is between 30 and 50 degrees.

4. Pipette tip according to claim 2, wherein said first angle ($\alpha$1; $\alpha$2; $\alpha$3) is between 30 and 45 degrees.

5. Pipette tip according to claim 1, wherein said second angle differs in dependence on the location on the edge surface such that second angle is largest at a most extending part (10*a*) of said second end.

6. Pipette tip according to claim 1, wherein said edge is inclined at said second angle ($\beta$1; $\beta$2; $\beta$3) only for part of said opening.

7. Pipette tip according to claim 1, wherein said thermoplast is one of the group consisting of polycarbonate, polyphenyleneoxide, thermoplastic polyurethane, thermoplastic polysulfone, thermoplastic polyetherimide, thermoplastic polyethersulfone, thermoplastic polyphenylsulfone, and polypropelyne.

8. Pipette tip according to claim 7, wherein said pipette tip (5*a*) is reinforced with at least one of carbon fibers and glass fibers.

9. Pipette tip according to claim 1 wherein a part (10*c*) of the edge (10) does not have a sharp profile.

10. Pipette tip according to claim 9, wherein said part (10*c*) of said edge (10) is rounded at at least one of its inside and outside.

11. Pipette tip according to claim 9, wherein said edge (10) has a total length and said part (10*c*) of the edge (10) extends along a maximum of 10% of said total length.

12. Pipette tip according to claim 11, wherein said part (10*c*) of the edge (10) extends along a maximum of 5% of said total length.

13. Pipette tip according to claim 11, wherein said part (10*c*) of the edge (10) extends along a maximum of 3% of said total length.

14. Pipette tip according to claim 1, including an electrically conducting material, as an additive such as to allow sensing of a liquid.

15. A pipette provided with a pipette tip according to claim 1.

16. A robotic pipetter comprising a pipette according to claim 15.

17. A set comprising a pipette with a pipette tip according to claim 15, as well as at least one enclosure covered with a cover and containing a sample, which sample is, at least in part, to be drawn from said enclosure with said pipette.

18. Pipette tip according to claim 1, including a carbon material as an additive such as to allow sensing of a liquid.

19. A method of drawing at least in part a sample from an enclosure, comprising:

a) providing a pipette with a pipette body and a pipette tip comprising a first end fitted to the pipette body (3); and a second end with an opening (15) defined by an edge (10) arranged to be inserted in a sample which is at least in part intended to be drawn up by said pipette, wherein said second end with said opening (15) has a sharp profile such that said second end can cut through a cover (119) covering an enclosure containing said sample, said sharp profile being implemented by: i) said second end with said opening (15) being inclined at a first angle ($\alpha$1; $\alpha$2; $\alpha$3) relative to a plane (19) defined perpendicular relative to a central axis (17) of said pipette tip (5*a*), said first angle ($\alpha$1; $\alpha$2; $\alpha$3) being >0, and ii) said edge (10) having a surface which is inclined at a second, extra angle ($\beta$1; $\beta$2; $\beta$3) starting from said opening, and wherein said pipette tip (5*a*) is comprised of thermoplast;

b) providing an enclosure covered with a cover and containing a sample;

c) cutting through said cover with said pipette;

d) drawing up said sample, at least in part, by means of said pipette.

20. A method of drawing at least in part a sample from an enclosure, comprising:

providing a robotic pipette with a pupette body and a pipette tip comprising a first end fitted to the pipette body (3) of a pipette (1); and a second end with an opening (15) defined by an edge (10) arranged to be inserted in a sample which is at least in part intended to be drawn up by said pipette, wherein said second end with said opening (15) has a sharp profile such that said second end can cut through a cover (119) covering an enclosure containing said sample, said sharp profile being implemented by: i) said second end with said opening (15) being inclined at a first angle relative to a plane (19) defined perpendicular relative to a central axis (17) of said pipette tip (5*a*), said first angle being >0, and ii) said edge (10) having a surface which is inclined at a second, extra angle starting from said opening, and wherein said pipette tip (5*a*) is comprised of thermoplast;

b) providing an enclosure covered with a cover and containing a sample;

c) cutting through said cover with said robotic pipette;

d) drawing up said sample, at least in part, by means of said robotic pipette.

* * * * *